US011276927B2

(12) United States Patent
Logothetis et al.

(10) Patent No.: US 11,276,927 B2
(45) Date of Patent: Mar. 15, 2022

(54) MOVEABLE ANTENNA APPARATUS

(71) Applicant: AIRSPAN IP HOLDCO LLC, Boca Raton, FL (US)

(72) Inventors: Andrew Logothetis, Buckinghamshire (GB); David Charles Brokenshire, Berkshire (GB)

(73) Assignee: AIRSPAN IP HOLDCO LLC, Boca Raton, FL (US)

( * ) Notice: Subject to any disclaimer, the term of this patent is extended or adjusted under 35 U.S.C. 154(b) by 324 days.

(21) Appl. No.: 16/373,953

(22) Filed: Apr. 3, 2019

(65) Prior Publication Data

US 2019/0312349 A1 Oct. 10, 2019

(30) Foreign Application Priority Data

Apr. 9, 2018 (GB) ..... 1805878

(51) Int. Cl.

| | |
|---|---|
| ***H01Q 1/12*** | (2006.01) |
| ***H01Q 3/06*** | (2006.01) |
| ***H01Q 21/28*** | (2006.01) |
| ***H01Q 25/00*** | (2006.01) |
| ***H01Q 1/08*** | (2006.01) |

(52) U.S. Cl.

CPC ..... *H01Q 3/06* (2013.01); *H01Q 1/084* (2013.01); *H01Q 1/1264* (2013.01); *H01Q 21/28* (2013.01); *H01Q 25/005* (2013.01)

(58) Field of Classification Search

CPC .. H01Q 3/06; H01Q 3/02; H01Q 3/00; H01Q 1/1264; H01Q 1/084; H01Q 1/125; H01Q 21/28; H01Q 25/005; H01Q 25/00

See application file for complete search history.

(56) References Cited

U.S. PATENT DOCUMENTS

| | | | | |
|---|---|---|---|---|
| 6,198,460 | B1 * | 3/2001 | Brankovic ..... | H01Q 1/1242 343/700 MS |
| 6,448,930 | B1 | 9/2002 | Judd | |
| 2006/0132370 | A1 | 6/2006 | Tietjen et al. | |
| 2006/0192715 | A1 | 8/2006 | Kim | |
| 2007/0013593 | A1 * | 1/2007 | Zafar ..... | H04B 7/18534 343/713 |

(Continued)

FOREIGN PATENT DOCUMENTS

WO 2007069809 A1 6/2007

OTHER PUBLICATIONS

PCT Search Report and Written Opinion from PCT/GB2019/050486 dated May 20, 2019, 17 pages.
GB Search Report from GB1805878.4 dated Sep. 5, 2018, 4 pages.

*Primary Examiner* — Awat M Salih
(74) *Attorney, Agent, or Firm* — Haynes Beffel & Wolfeld LLP; Andrew Dunlap

(57) ABSTRACT

The present technique provides an antenna apparatus and a method of operating an antenna apparatus comprising a first antenna array and a second antenna array. Antenna positioning circuitry is used to move the first antenna array relative to the second antenna array about a common axis of rotation to facilitate positioning of the first and second antenna arrays in a chosen deployment configuration between a first limit and a second limit. Antenna array control circuitry is used to coordinate operation of the first antenna array and the second antenna array dependent on the chosen deployment configuration.

15 Claims, 5 Drawing Sheets

(56) References Cited

U.S. PATENT DOCUMENTS

| | | | | |
|---|---|---|---|---|
| 2007/0060046 | A1 | 3/2007 | Lee et al. | |
| 2008/0136718 | A1* | 6/2008 | Tietjen | H01Q 1/1235 343/711 |
| 2009/0267835 | A1 | 10/2009 | Tietjen | |
| 2009/0312057 | A1 | 12/2009 | Moon et al. | |
| 2012/0280874 | A1 | 11/2012 | Kim et al. | |
| 2013/0169495 | A1 | 7/2013 | Tsai et al. | |
| 2014/0103184 | A1 | 4/2014 | Asrokin et al. | |
| 2015/0222013 | A1 | 8/2015 | Choi et al. | |

* cited by examiner

MOVEABLE ANTENNA APPARATUS

BACKGROUND

The present technique relates to the field of wireless communications.

In modern wireless communications systems, there is a move towards using higher frequency signals, with the aim of increasing the bandwidth. However, path loss issues become more significant as higher frequencies are used, and accordingly there is a tendency to use narrow beams in order to deliver coverage to the edge of the cells within the wireless communications system. However, an issue that then arises is how to direct beams in an appropriate manner, so as to enable communication with items of user equipment within the cells.

Some antenna arrays can be directed towards a target by electronically steering the beam away from its boresight direction (the direction of maximum gain for the apparatus). However, this has negative effects on the quality of communications transmitted from or received by the antenna because (i) the beam broadens and (ii) gain loss increases as the beam is steered further from its boresight direction. FIG. 1 shows an example of this, depicting a beam 11 steered to 60° from boresight and a beam 13 directed in its boresight direction, showing that the beam 11 electronically steered to 60° is twice as broad as the beam 13 directed in its boresight direction, as well as showing significant gain loss of approximately 9 dB. This can hence impact the ability of the antenna array to provide the desired level of coverage within a cell.

SUMMARY

Viewed from one aspect, the present technique provides an antenna apparatus, comprising:

a first antenna array and a second antenna array;

antenna positioning circuitry configured to move the first antenna array relative to the second antenna array about a common axis of rotation to facilitate positioning of the first and second antenna arrays in a chosen deployment configuration between a first limit and a second limit; and antenna array control circuitry configured to coordinate operation of the first antenna array and the second antenna array dependent on the chosen deployment configuration.

Viewed from another aspect, the present technique provides a method of operating an antenna apparatus comprising a first antenna array and a second antenna array, the method comprising:

moving the first antenna array relative to the second antenna array about a common axis of rotation to facilitate positioning of the first and second antenna arrays in a chosen deployment configuration between a first limit and a second limit; and coordinating operation of the first antenna array and the second antenna array dependent on the chosen deployment configuration.

Viewed from a yet further aspect, the present technique provides an antenna apparatus, comprising:

first antenna array means and second antenna array means;

antenna positioning means for moving the first antenna array means relative to the second antenna array means about a common axis of rotation to facilitate positioning of the first and second antenna array means in a chosen deployment configuration between a first limit and a second limit; and antenna array control means for coordinating operation of the first antenna array means and the second antenna array means dependent on the chosen deployment configuration.

BRIEF DESCRIPTION OF THE DRAWINGS

Further aspects, features and advantages of the present technique will be apparent from the following description of examples, which is to be read in conjunction with the accompanying drawings, in which.

DESCRIPTION OF EXAMPLES

Figure 1:
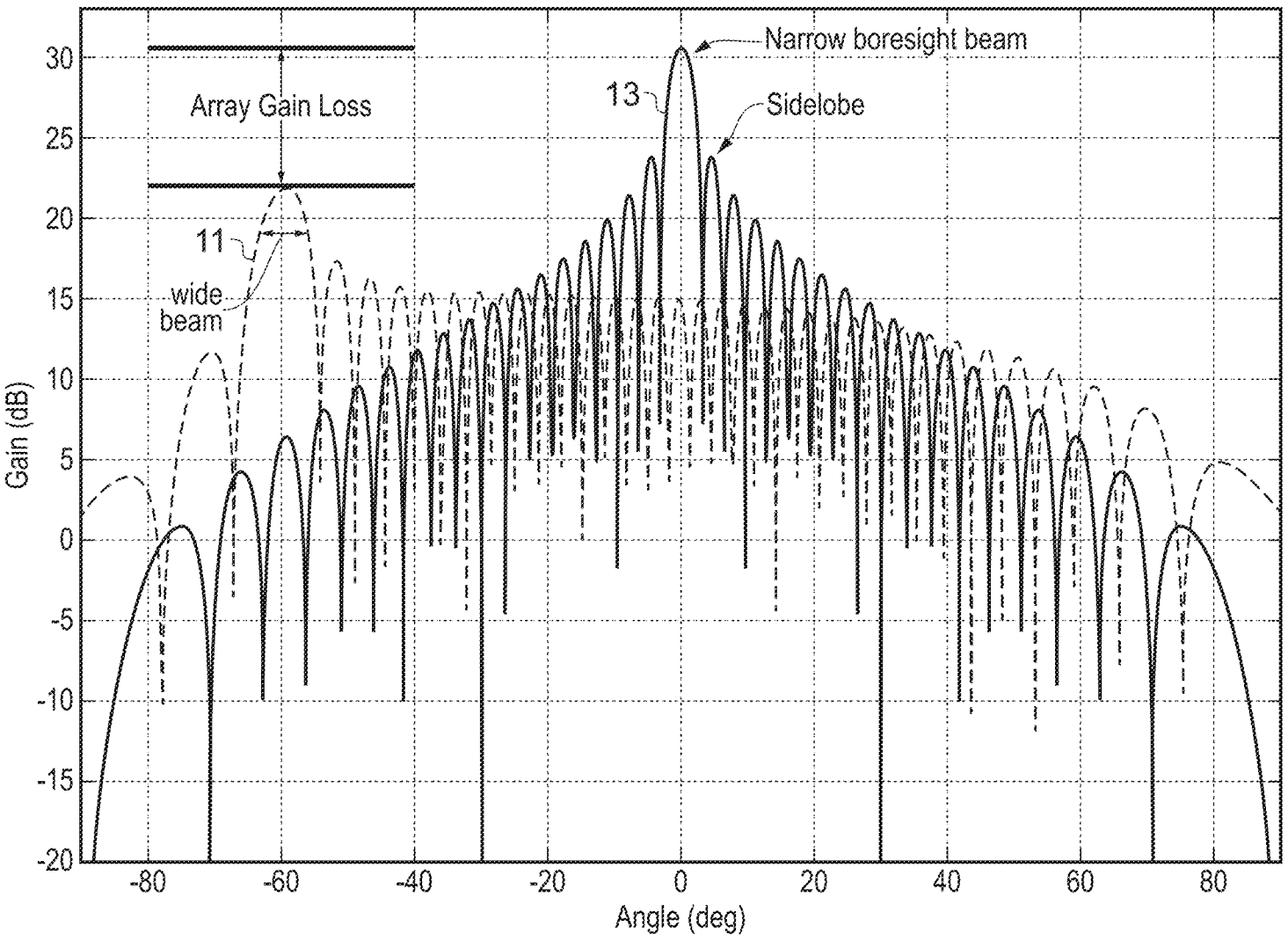
FIG. 1 is a graph of the gain of a beam of an antenna when electronically steered to various angles.

Before discussing the embodiments with reference to the accompanying figures, the following description of example configurations and associated advantages is provided.

In accordance with one example configuration there is provided an antenna apparatus, comprising a first antenna array and a second antenna array, and antenna positioning circuitry to move the first antenna array relative to the second antenna array about a common axis of rotation to facilitate positioning of the first and second antenna arrays in a chosen deployment configuration between a first limit and a second limit. Further, antenna array control circuitry is provided to coordinate operation of the first antenna array and the second antenna array dependent on the chosen deployment configuration.

By providing antenna positioning circuitry to move a first antenna array relative to a second antenna array, the antenna apparatus can be mechanically steered to change the boresight direction of one or both antenna arrays. This allows the antenna apparatus to be directed towards a target without the beam broadening and gain loss associated with purely electronically steering an antenna apparatus. This arrangement allows a broad area to be covered by a single antenna apparatus by providing at least two antenna arrays configured to coordinate their operation, and moveable with respect to one another. This also allows the mode of operation of the antenna apparatus to be varied effectively, based on the chosen deployment configuration. The first antenna array and the second antenna array can, for example, each be a uniform linear array (ULA) comprising a number of antenna elements, although any other form of antenna array may be used.

In some examples, at the first limit, the first and second antenna arrays are positioned adjacent to each other to face in the same direction, while at the second limit, the first and second antenna arrays are positioned back-to-back to face in opposing directions.

By setting the first and second limits to be in adjacent and back-to-back arrangements respectively, a wide range of areas can be covered by a single antenna apparatus, and a variety of different deployment configurations can be accommodated. At the first limit, the antenna arrays may be coplanar, such that their boresight directions are in substantially the same direction, although the boresight directions are not necessarily in exactly the same direction. In the first limit, the angle between the antenna arrays is 180° or close to 180° (for example it could be within ±10° of 180°, or it could be further from 180°, depending on the requirements and capabilities of the system). At the second limit, the antenna arrays may be parallel to one another but facing in opposing directions, such that their boresight directions are in substantially opposite directions, although the boresight directions need not necessarily be in exactly opposing directions. In the second limit, the angle between the first and second antenna arrays is 0° of close to 0° (for example it could be within ±10° of 0°, or it could be further from 0°, depending on the requirements and capabilities of the system)—this angle could also be referred to as 360° or close to 360°. The exact angles of the first and second limits need not be limited to 180° and 0° respectively, but may be determined in dependence on the requirements of the system.

There are a number of ways in which the common axis of rotation can be defined within the antenna apparatus. In some examples, the first antenna array is mounted on a first support and the second antenna array is mounted on a second support, and the first and second supports are coupled by a hinge mechanism, wherein the hinge mechanism defines the common axis of rotation.

Mounting the antenna arrays on supports coupled by a hinge mechanism provides a simple and efficient technique for facilitating the movement of the first antenna array relative to the second antenna array. The first and second supports may be any structure on which the antenna arrays can be mounted, for example a flat plate, a beam, or any other suitable structure. The supports may be configured to move relative to one another by folding or unfolding of the hinge mechanism, such that they are rotated relative to one another about a centre of rotation defined by the centre of rotation of the hinge mechanism.

The antenna positioning system can take a variety of forms. However, in one example arrangement, the antenna positioning circuitry is configured to facilitate reciprocating motion of a first end of at least one of the first and second supports along a linear path.

This allows the position of the first antenna array relative to the second antenna array to be adjusted by moving one or both of the supports linearly, via reciprocal (reciprocating) motion of one end of one or both supports along a linear path, simplifying the operation and construction of the antenna apparatus.

In some examples, the antenna positioning circuitry comprises a linear structure and the antenna apparatus comprises an attachment member to couple the first end of the at least one of the first and second supports to the linear structure to support the reciprocating motion.

The attachment member may be any structure configured to moveably attach the first end of one or both of the supports to the linear structure such that that first end can move along the linear structure.

There are a number of ways in which the reciprocating motion can be effected. In some examples, the antenna positioning circuitry comprises a motor configured to facilitate the reciprocating motion by causing reciprocating movement of the attachment member along the linear structure.

By providing the apparatus with a motor to facilitate the reciprocating motion, the movement of the first antenna array relative to the second antenna array can be controlled electronically or performed automatically. The motor can, for example, be controlled by the antenna positioning circuitry.

In some examples, the motor is configured to facilitate the reciprocating motion by driving the attachment member to move along the linear structure.

Arranging the motor in this way allows the motion of the first antenna array relative to the second antenna array to be facilitated through linear motion of one or both of the supports, such that the motion can be electronically controlled.

In an alternative arrangement, the linear structure and the attachment member comprise complementary threading, and the motor may be configured to facilitate the reciprocating motion by driving the rotation of at least one of the linear support and the attachment member.

This provides a simple technique for facilitating the reciprocal motion of one or both supports along the linear structure. The motor may be configured to rotate the linear support, such that the attachment member moves linearly along the structure. Alternatively, the motor may rotate the attachment member to cause it to move linearly along the support. In this case, in some examples, the attachment member is coupled to the first end of the at least one of the first and second supports in a rotatable attachment, such that it can rotate independently of the support.

In some examples, the first end of one of the supports is maintained at a fixed position relative to the linear structure, and the first end of the other support is coupled to the attachment member.

This allows the motion of one antenna array relative to the other about a common axis of rotation to be controlled simply and with a reduced number of moving parts, increasing the ease of manufacture and the robustness of the apparatus. With one end of one support fixed, motion of just one support (specifically, one end of the other support) linearly along a linear path allows the first support to be moved relative to the other support about a common axis of rotation, and hence allows a great deal of flexibility in the positioning of the first antenna array relative to the second antenna array.

Whilst in accordance with the above described techniques, the predominant adjustment to the beam pattern is made by mechanical movement of the first antenna array relative to the second antenna array, in some examples the first and second antenna arrays may also be configured to be electronically steered.

This allows further directionality to be provided in addition to the directionality provided by the relative motion of one antenna array relative to the other.

In some examples, the antenna apparatus is operable in a chosen mode which is one of a relay mode, a point-to-point mode, a point-to-multipoint mode and any combination thereof, and the chosen deployment configuration is chosen in dependence on the chosen mode.

In this way, a variety of modes of operation are possible for a single antenna apparatus, improving the utility and versatility of the apparatus. Relay mode involves, in some examples, receiving a transmission and then transmitting the same transmission to some target, point-to-point mode involves a transmission sent from a single location to a different single location, and point-to-multipoint mode involves sending a transmission from a single point to a plurality of targets. The antenna apparatus may be operated in any of these modes or in any combination of these modes. For example, the antenna may be configured such that one antenna array is used in a relay configuration to relay backhaul data in one direction, whilst the other antenna array is used in a point-to-multipoint configuration to offload data traffic to a number of users in another direction. The deployment configuration may be selected in dependence on the mode in which the antenna apparatus is operating.

In some examples, the antenna apparatus is configured for rotation about a further axis parallel to the common axis of rotation.

This allows the antenna apparatus to be rotated with two degrees of freedom, extending the size of the area that can be covered by a single antenna apparatus. The antenna apparatus can hence be used in a variety of configurations or modes in a variety of different directions, increasing the adaptability of the apparatus.

The antenna apparatus has a length in the direction of the linear structure, and in some examples has a rotation mechanism to facilitate rotation of the antenna apparatus about a centre point of the length to cause rotation about the further axis. This enables the rotation about the further axis to be accommodated within a compact design.

The length could be defined in various ways. In some examples, the length is defined in terms of the linear structure, although in other examples the length may be defined differently.

In some examples the first and second antenna arrays are configured to operate using the same frequency channel or different frequency channels in dependence on the chosen deployment configuration. Hence, there is a great degree of freedom as to how the individual antenna arrays are used in a cooperative manner.

Particular embodiments will now be described with reference to the figures.

FIG. 1 is a graph of gain versus the angle between the direction of the beam of an antenna apparatus and the boresight direction, where the boresight direction is the direction of maximum gain for the antenna or antenna array. As shown in the figure, a beam 13 aligned to point in its boresight direction (e.g. an angle of 0°) may be designed to have a narrow boresight beam (shown as the central peak in the graph) with maximal gain. In contrast, a beam electronically steered away from the boresight direction has a reduced gain and increased beam width. For example, in FIG. 1, the beam 11 electronically steered 60° away from the boresight direction has a beam width approximately twice that of the beam 13 at boresight, with a gain around 9 dB lower. For completeness, the side lobes for both beams are shown within FIG. 1, but are not of relevance to the present discussion.

In modern communications systems using high frequencies, narrow beams are used to seek to deliver coverage to the edge of the cell. However, as is apparent from FIG. 1, as the narrow beam is electronically steered in order to seek to cover areas of the cell away from the boresight direction, there are significant attenuation losses which can make it difficult to maintain coverage, particularly at the edges of the cell associated with the antenna apparatus. Whilst at the time of initial deployment of the antenna apparatus, the predominant direction of the antenna array (and hence its boresight direction) may be able to be selected by the mechanical positioning of the apparatus, it is often the case that electronic beam steering is then used to tune the direction of the beam in use. However, as is evident by FIG. 1, coverage issues can arise when narrow beams are used. The techniques described herein aim to alleviate these issues, by providing a mechanism by which an antenna apparatus is provided with first and second antenna arrays which can have their orientation with respect to each other mechanically adjusted during use. This provides a great deal of flexibility in the provision of suitable beam coverage within a cell in which the antenna apparatus is deployed, and enables a number of different modes of operation of the antenna apparatus to be readily supported.

Figure 2:
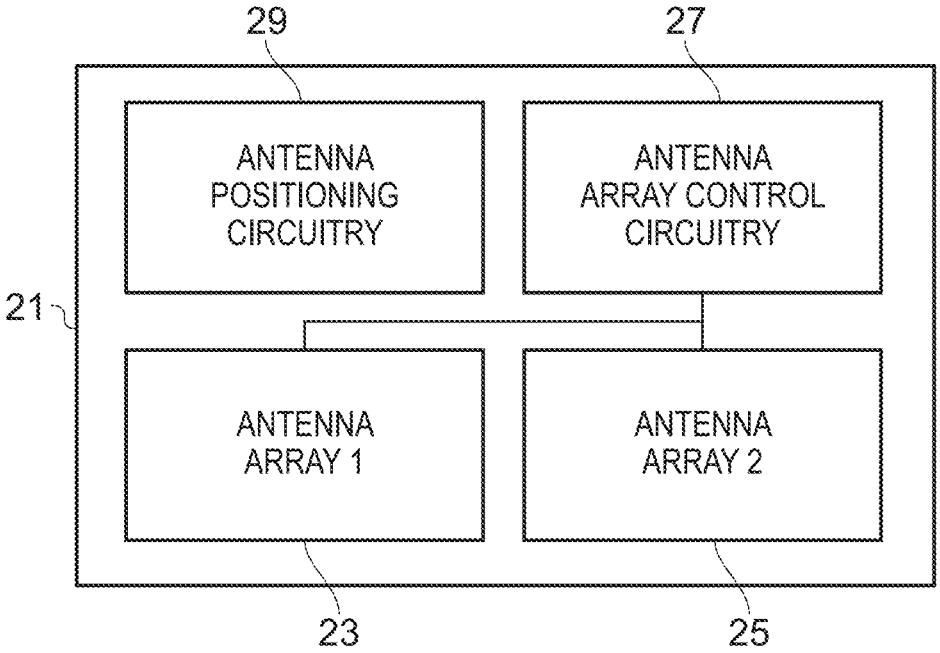
FIG. 2 is a block diagram of an antenna apparatus according to an example of the present technique.

FIG. 2 shows a block diagram of an antenna apparatus 21 according to an example configuration of the present technique. FIG. 2 shows two antenna arrays 23, 25, antenna array control circuitry 27 and antenna positioning circuitry 29. The antenna arrays 23, 25 are configured to be moveable relative to one another about a common axis of rotation. The antenna positioning circuitry 29 is configured to control the motion of the antenna arrays 23, 25 relative to one another. The antenna arrays 23, 25 are configured to work in a coordinated manner, in dependence on their deployment configuration, and the antenna array control circuitry 27 is configured to control the antenna arrays and coordinate their operations. Although FIG. 2 only shows two antenna arrays, it will be appreciated that additional antenna arrays may also be provided.

Figure 3:
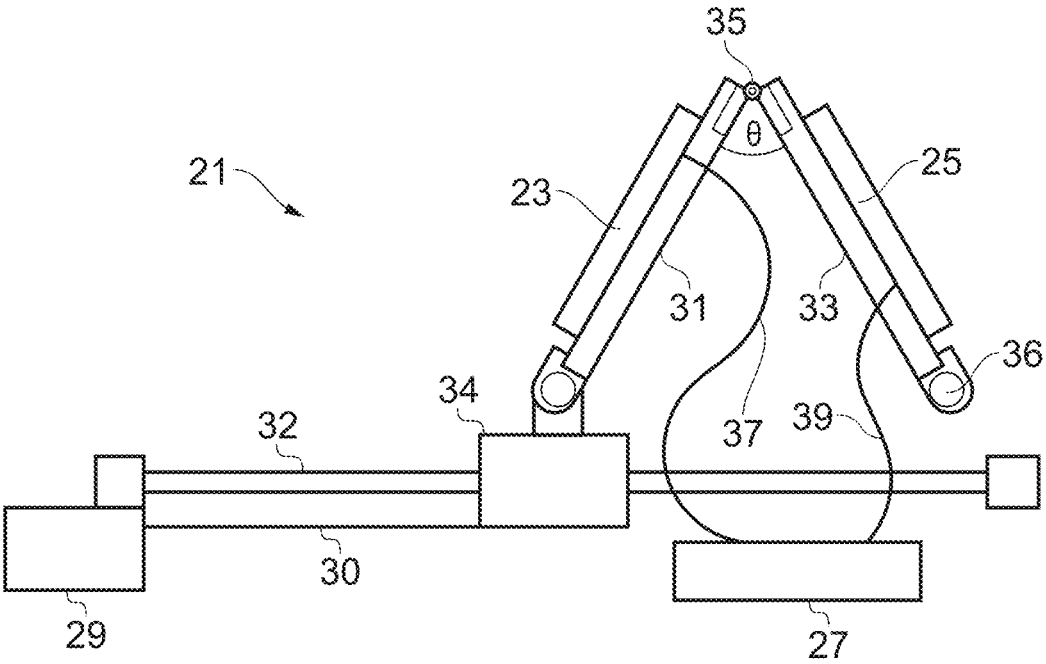
FIGS. 3 to 5 show an antenna apparatus according to an example of the present technique, in different deployment configurations.

FIG. 3 shows a schematic of an antenna apparatus 21 according to an example configuration of the present technique. In FIG. 3, the two antenna arrays 23 and 25 are each mounted on a support 31, 33. The supports 31, 33 are attached by a hinge 35 which, in the figure, is depicted as a butt hinge, however any other type of hinge may be used in place of a butt hinge. The hinge 35 allows the motion of one antenna array 23, 25 relative to the other, and defines the common axis of rotation about which the antenna arrays 23, 25 are configured to move. The hinge 35 allows the supports 31, 33 to be moved such as to vary the angle θ between them, where the angle θ also defines the angle between the antenna arrays 23, 25. The antenna apparatus 21 of FIG. 3 also includes antenna array control circuitry 27 coupled to the antenna arrays 23, 25 by flexible wires 37, 39. The antenna array control circuitry 27 is configured to control the coordinated operation of the antenna arrays 23, 25, by appropriate control of aspects such as the beam pattern used by each antenna array, the frequency channel used by each antenna array, the type of communications facilitated by each antenna array (relay, point-to-point, point to multipoint, etc.). The antenna array control circuitry 27 may also be used to electronically steer the beams of the two antenna arrays 23, 25 if desired.

One end of one of the supports 31 is coupled to a linear structure 32 by an attachment member 34. In this example, the attachment member 34 is configured to be slideable along the linear structure 32, which in this case may be a linear track, allowing the end of the support 31 to be linearly translated along the linear support, such as to vary the angle θ between the antenna arrays 23, 25. The antenna apparatus 21 also includes antenna positioning circuitry 29 which includes a motor (not shown separately) configured to move the attachment member 34 along the linear structure 32. The motor in the antenna positioning circuitry 29 is coupled to the attachment member 34 by a drive mechanism 30, which can be any suitable means that enables the motor to drive the attachment member 34, and is merely shown schematically in the figures by the element 30. The antenna positioning circuitry 21 includes electronics configured to control the relative motion of the antenna arrays 23, 25. The motor does not necessarily need to be integrally formed with the antenna positioning circuitry as in FIG. 3, but can instead be separate. Further, the antenna positioning circuitry can be provided at any suitable location within the apparatus, but in FIG. 3 is shown as being attached to, or integral with, one of the end stops of the linear structure 32. However, it can be useful for the motor position to be static so as to reduce the complexity of moving parts and the amount of flexible cabling.

One end of the other support 33 is fixed relative to the linear structure 32 at an anchor point 36. As a result of this, motion of the end of the first support 31 along the linear structure 32 increases or decreases the angle θ between the antenna arrays 23, 25 between a first limit and a second limit, such that a particular deployment configuration (a particular angle θ) can be selected from between the first and second limits.

Figure 4:
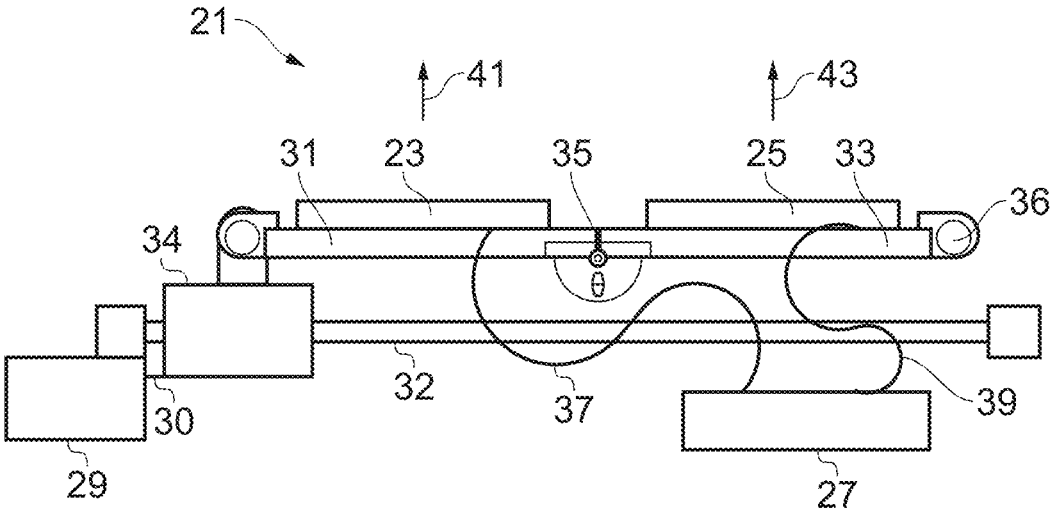

FIG. 4 shows a schematic of the antenna apparatus 21 in a particular deployment configuration according to an example configuration of the present technique. In FIG. 4, the antenna arrays 23, 25 are arranged adjacent to one another so that they face the same direction (e.g. their boresight directions are aligned, shown by arrows 41 and 43 in the figure). In this example, the angle θ between the supports 31, 33 is 180°. The attachment member 34 has been linearly translated along the linear structure 32 away from the fixed anchor point 36, causing the ends of the supports 31, 33 which are not coupled by the hinge 35 to be moved apart, such that the hinge 35 extends towards an open position. In some examples, this arrangement may be one of the limits between which the antenna arrays 23, 25 can be moved, although in other examples the first limit may be a different configuration, for example the angle θ in the first limit may be more or less than 180°, depending on the requirements of the system.

In this side-by-side configuration, the antenna arrays 23, 25 can be directed towards the same target. The area covered by the antenna apparatus 21 in this configuration can be configured to be narrow, with higher gain than in other configurations, since if both antenna arrays 23, 25 are arranged to operate in the same frequency channel, devices in the area can receive a transmission from both antenna arrays 23, 25 at once, potentially doubling throughput. However, other modes of operation are also possible; for example the two antenna arrays 23, 25 may be electronically steered to point in different directions, in order to increase the area of the region covered by the antenna apparatus 21 in this configuration. Alternatively, the antenna arrays 23, 25 may each operate in a different frequency channel, allowing them to service different areas or different devices in the same area without interfering with each other.

Figure 5:
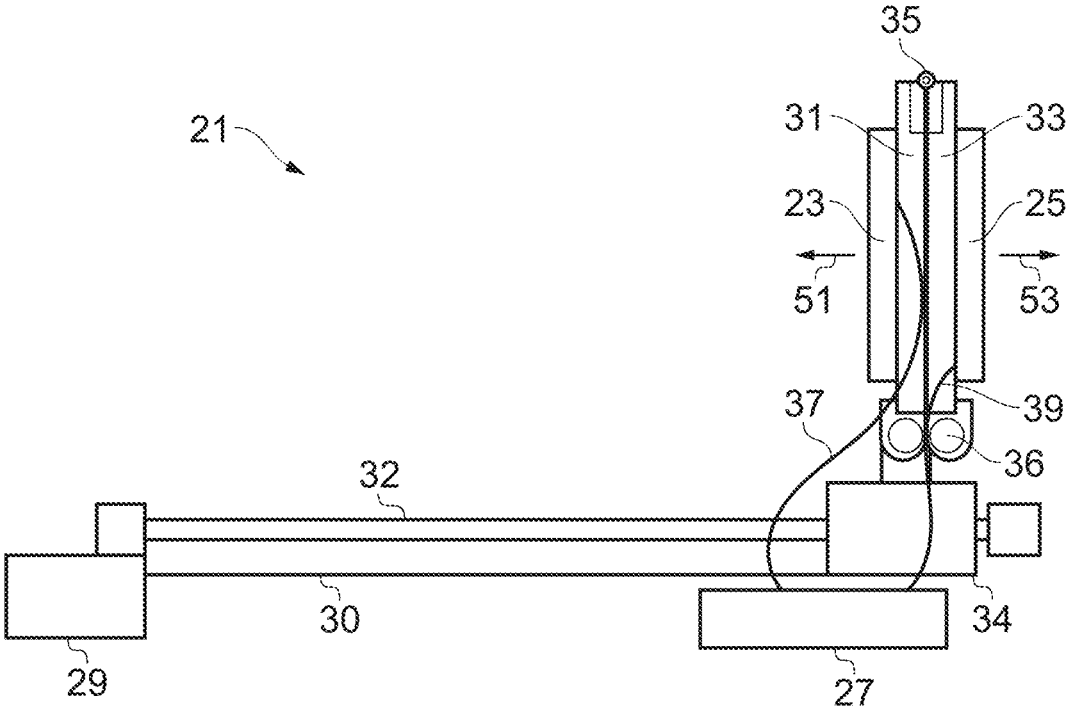

FIG. 5 shows a schematic of the antenna apparatus 21 in a different deployment configuration according to an example configuration of the present technique. In FIG. 5, the antenna arrays 23, 25 are arranged back to back so that they face in opposite directions (e.g. their boresight directions 51, 53 are in opposing directions). In this example, the angle θ between the supports 31, 33 is 0° (or 360°). The attachment member 34 has been linearly translated along the linear structure 32 towards the fixed anchor point 36, causing the ends of the supports 31, 33 which are not coupled by the hinge 35 to be moved together, such that the hinge 35 rotates towards a closed position. In some examples, this arrangement may be one of the limits between which the antenna arrays 23, 25 can be moved, although in other examples the second limit may be a different configuration, for example the angle θ in the second limit may be more than 0°, depending on the requirements of the system.

In this back-to-back configuration, the antenna arrays 23, 25 can be directed towards different targets. The area covered by the antenna apparatus 21 in this configuration has two lobes—that is, the area comprises two parts, one covered by each antenna array 23, 25. In this configuration, the antenna apparatus 21 may act in relay mode, for example. In relay mode, one of the antenna arrays 23, 25 acts as a receiver and receives a transmission, while the other acts as a transmitter transmitting the received transmission to a further antenna apparatus. However, alternatively, the antenna arrays can each be arranged as transmitters or receivers having different coverage areas within the cell. When they are both arranged as transmitters, the transmission may be carried out in point-to-point mode, in which the antenna array 23, 25 transmits to a single receiver, or in point-to-multipoint mode, in which the antenna array 23, 25 transmits to a plurality of receivers. The antenna arrays 23, 25 may be configured to operate on the same frequency channel or on different frequency channels.

Figure 6:
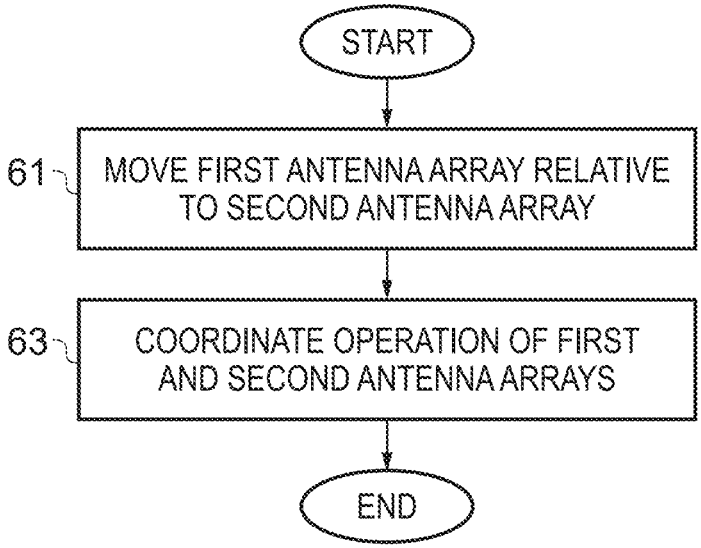
FIG. 6 is a flow diagram of a method of operating an antenna apparatus according to one example of the present technique.

FIG. 6 is a flow diagram showing a method of operating an antenna apparatus according to the present technique. The antenna apparatus comprises at least two antenna arrays and, in step 61, the first antenna array is moved relative to the second antenna array. These could be the antenna arrays 23, 25 of FIGS. 2 to 5, and the step 61 of moving one relative to the other involves moving the first antenna array relative to the second antenna array about a common axis of rotation, where the common axis of rotation is, in some examples, defined by a hinge apparatus 35. The first antenna array is moved 61 relative to the second antenna array to position the antenna apparatus in a deployment configuration chosen from a plurality of possible deployment configurations between a first limit and a second limit. The antenna arrays may be moved 61 relative to each other according to any of the techniques described above in relation to FIGS. 2-5. In step 63, operation of the first and second antenna arrays is coordinated by the antenna array control circuitry 27. This allows the antenna arrays to receive and/or transmit signals in coordination, according to the chosen deployment configuration. The antenna arrays can operate in any of a variety of modes, including relay mode, point-to-point mode, point-to-multipoint mode or any combination of the previous three modes.

Figure 7:
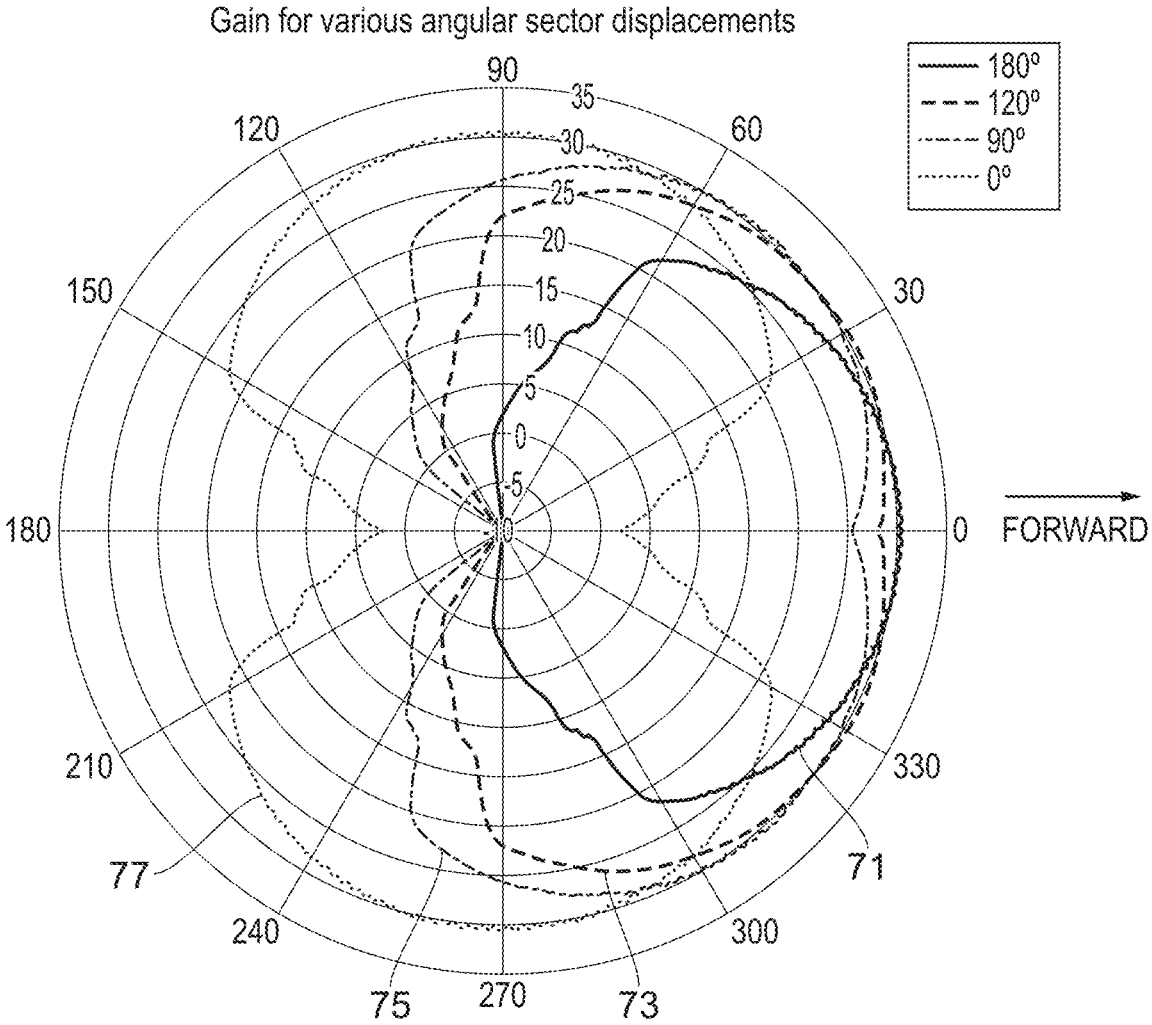
FIG. 7 is a graph of gain versus beam direction for an antenna apparatus in various configurations according to the present technique.

FIG. 7 is graph showing the areas covered by an antenna apparatus 21 according to the present technique in a number of deployment configurations. In one deployment configuration 71, in which the first and second antenna arrays 23, 25 are positioned adjacent to one another (e.g. when θ=180° as shown in FIG. 4) such that their boresight directions are aligned, the area covered by the apparatus is shown as fairly narrow. This configuration 71 allows both antenna arrays 23, 25 to be directed towards the same target. As FIG. 7 shows, decreasing the angle θ increases the size of the area covered by the antenna apparatus 21, but sacrifices gain in the forward direction. In particular in the deployment configuration 73, at θ=120°, the area covered by the antenna apparatus 21 is broader than the configuration 71 at θ=180°, but the gain in the forward direction is slightly reduced. Similarly, in the deployment configuration 75, at θ=90°, the area covered by the antenna apparatus 21 is even broader than at θ=120°, but the gain in the forward direction is even less. The final configuration 77 shown in FIG. 7 is θ=0°, where the first and second antenna arrays 23. 25 are positioned back-to-back, so that they have their boresight directions in opposing directions. In this configuration 77, the gain in the forward direction is significantly lower than in the other configurations, but the gain in the two sideways directions is much higher. This configuration 77 may be particularly useful in relay mode, where one of the two antenna arrays 23, 25 receives a signal from one direction and the other transmits the same signal in an opposing direction.

As FIG. 7 demonstrates, the arrangement of the antenna apparatus 21 according to the present technique provides significant flexibility, and allows the apparatus 21 to be arranged in a wide variety of deployment configurations, which can be tailored to the needs of the system. Although FIG. 7 only shows the coverage for 4 deployment configurations, it will be appreciated that a deployment with any angle θ can be chosen.

Figure 8:
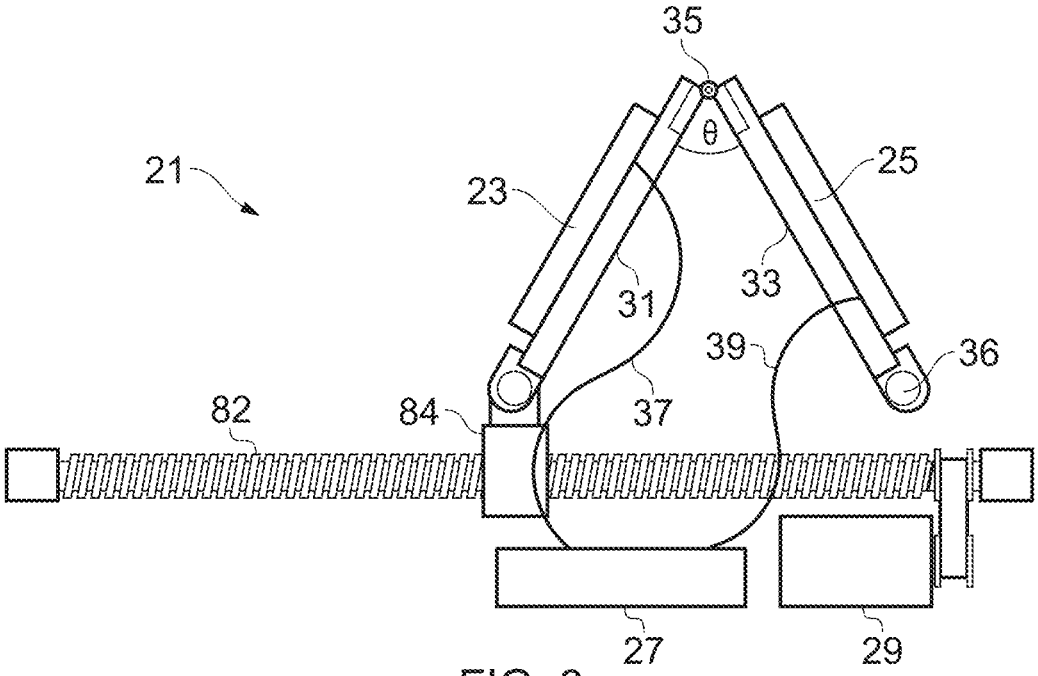
FIG. 8 is a schematic of an antenna apparatus according to another example of the present technique.

FIG. 8 shows a schematic of an embodiment of the antenna apparatus 21 according to the present technique, in which one of the supports 31 is mounted to a threaded linear structure 82 with a threaded attachment member 84. The attachment member 84 and linear structure 82 have complementary threading. In this configuration, the antenna positioning circuitry 29 is configured to control a motor to cause the linear structure 82 to rotate. In FIG. 8, as in FIGS. 3-5, the motor is within the antenna positioning circuitry 29, however in some examples the motor is separate from the antenna positioning circuitry. Due to the complementary threading on the linear structure 82 and the attachment member 84, the rotation of the linear structure 82 causes the attachment member to move along the linear structure towards or away from the anchor point 36. In this way, the angle θ can be decreased or increased in order to vary the deployment configuration of the antenna apparatus 21.

In some configurations, the antenna positioning circuitry 29 can be configured to drive the motor to cause the attachment member 84 to rotate instead of the linear structure 82, which similarly causes the attachment member 84 to move along the linear structure 82 towards or away from the anchor point 36. In this situation, the attachment member 84 is rotatably attached to the end of one of the linear supports 31, so that the attachment member can rotate without rotating the linear support 31.

Figure 9:
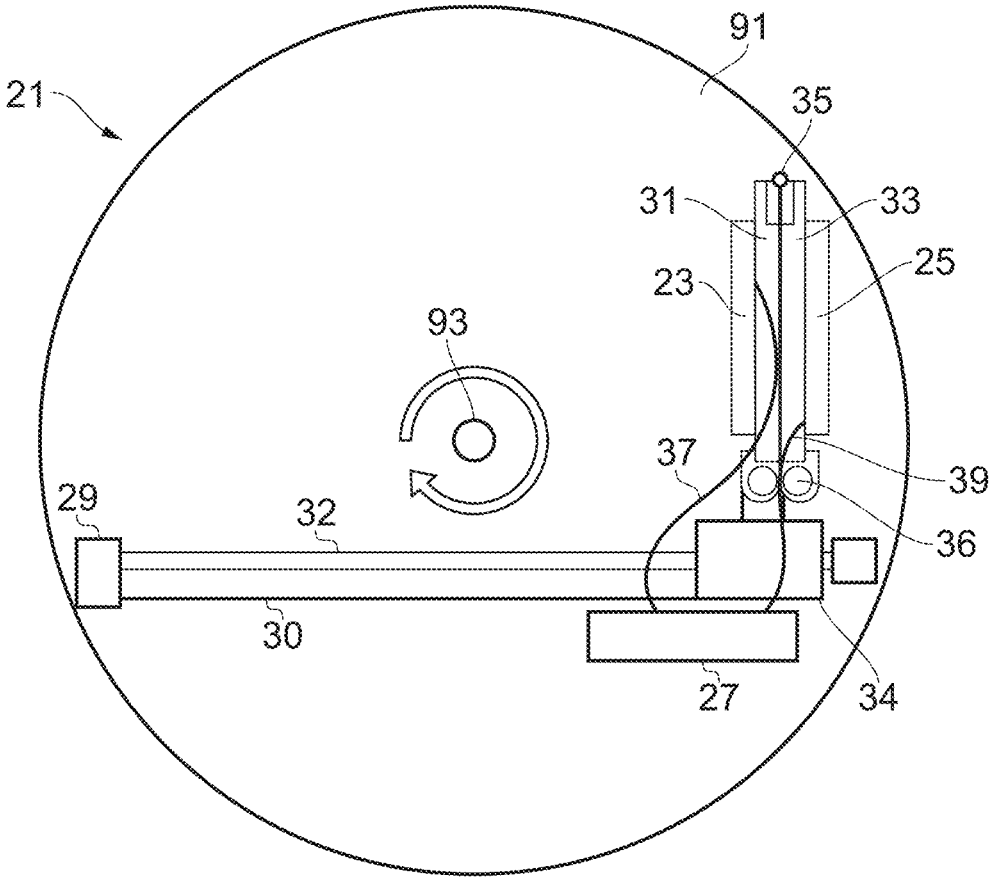
FIG. 9 is a schematic of an antenna apparatus according to one example implementation.

FIG. 9 shows a schematic of the antenna apparatus 21 according to one example configuration of the present technique. In FIG. 9, the antenna apparatus 21 includes a base plate 91 configured to rotate about a further axis of rotation 93, further increasing the size of the area covered by the apparatus 21. For example, any of the beam configurations illustrated in FIG. 7 that are formed by appropriate relative movement of the two antenna arrays can be rotated through 360° by rotation of the plate 91 about the axis 93. The base plate 91 may be coupled to a motor configured to drive its rotation about the axis 93, and the axis 93 is parallel to the common axis of rotation of the antenna arrays 23, 25 defined by the hinge 35. In the example of FIG. 9, the antenna positioning circuitry 29 is integrated into one of the end stops of the linear structure 32.

In the present application, the words "configured to . . . " are used to mean that an element of an apparatus has a configuration able to carry out the defined operation. In this context, a "configuration" means an arrangement or manner of interconnection of hardware or software. For example, the apparatus may have dedicated hardware which provides the defined operation, or a processor or other processing device may be programmed to perform the function. "Configured to" does not imply that the apparatus element needs to be changed in any way in order to provide the defined operation.

Although illustrative embodiments of the invention have been described in detail herein with reference to the accompanying drawings, it is to be understood that the invention is not limited to those precise embodiments, and that various changes and modifications can be effected therein by one skilled in the art without departing from the scope of the invention as defined by the appended claims.

The invention claimed is:

1. An antenna apparatus, comprising:

a first antenna array and a second antenna array;

antenna positioning circuitry configured to move the first antenna array relative to the second antenna array about a common axis of rotation to facilitate positioning of the first and second antenna arrays in a chosen deployment configuration between a first limit and a second limit; and antenna array control circuitry configured to coordinate operation of the first antenna array and the second antenna array dependent on the chosen deployment configuration;

wherein the antenna apparatus is configured to support a plurality of different modes of operation, the plurality of different modes of operation including a relay mode, a point-to-point mode, a point-to-multipoint mode and any combination thereof, and the antenna apparatus being configured to operate in a chosen mode of the plurality of different modes; and wherein the chosen deployment configuration is chosen in dependence on the chosen mode.

2. The antenna apparatus of claim 1, wherein:

at the first limit, the first and second antenna arrays are positioned adjacent to each other to face in a same direction; and at the second limit, the first and second antenna arrays are positioned back-to-back to face in opposing directions.

3. The antenna apparatus of claim 1, wherein:

the first antenna array is mounted on a first support and the second antenna array is mounted on a second support; and the first and second supports are coupled by a hinge mechanism, wherein the hinge mechanism defines the common axis of rotation.

4. The antenna apparatus of claim 3, wherein:

the antenna positioning circuitry is configured to facilitate reciprocating motion of a first end of at least one of the first and second supports along a linear path.

5. The antenna apparatus of claim 4, wherein:

the antenna positioning circuitry comprises a linear structure;

the antenna apparatus further comprising an attachment member to couple the first end of the at least one of the first and second supports to the linear structure to support the reciprocating motion.

6. The antenna apparatus of claim 5, wherein the antenna positioning circuitry comprises a motor configured to facilitate the reciprocating motion by causing reciprocating movement of the attachment member along the linear structure.

7. The antenna apparatus of claim 6, wherein:

the motor is configured to facilitate the reciprocating motion by driving the attachment member to move along the linear structure.

8. The antenna apparatus of claim 6, wherein:

the linear structure and the attachment member comprise complementary threading; and the motor is configured to facilitate the reciprocating motion by driving the rotation of at least one of the linear support and the attachment member.

9. The antenna apparatus of claim 5, wherein:

the first end of one of the supports is maintained at a fixed position relative to the linear structure, and the first end of the other support is coupled to the attachment member.

10. The antenna apparatus of claim 1, wherein the first and second antenna arrays are configured to be electronically steered.

11. The antenna apparatus of claim 1, wherein the antenna apparatus is configured for rotation about a further axis parallel to the common axis of rotation.

12. The antenna apparatus as claimed in claim 11, wherein:

the antenna positioning circuitry comprises a linear structure;

the antenna apparatus further comprises an attachment member to couple the first end of the at least one of the first and second supports to the linear structure to support the reciprocating motion; and wherein the antenna apparatus has a length in the direction of the linear structure, and has a rotation mechanism to facilitate rotation of the antenna apparatus about a centre point of the length to cause rotation about the further axis.

13. The antenna apparatus of claim 1, wherein the first and second antenna arrays are configured to operate using the same frequency channel or different frequency channels in dependence on the chosen deployment configuration.

14. A method of operating an antenna apparatus comprising a first antenna array and a second antenna array, the method comprising:

moving the first antenna array relative to the second antenna array about a common axis of rotation to facilitate positioning of the first and second antenna arrays in a chosen deployment configuration between a first limit and a second limit; and coordinating operation of the first antenna array and the second antenna array dependent on the chosen deployment configuration;

wherein the antenna apparatus is configured to support a plurality of different modes of operation, the plurality of different modes of operation including a relay mode, a point-to-point mode, a point-to-multipoint mode and any combination thereof, and the method comprising operating the antenna apparatus in a chosen mode of the plurality of different modes;

wherein the chosen deployment configuration is chosen in dependence on the chosen mode.

15. An antenna apparatus, comprising:

first antenna array means and second antenna array means;

antenna positioning means for moving the first antenna array means relative to the second antenna array means about a common axis of rotation to facilitate positioning of the first and second antenna array means in a chosen deployment configuration between a first limit and a second limit; and antenna array control means for coordinating operation of the first antenna array means and the second antenna array means dependent on the chosen deployment configuration;

wherein the antenna apparatus is configured to support a plurality of different modes of operation, the plurality of different modes of operation including a relay mode, a point-to-point mode, a point-to-multipoint mode and any combination thereof, and the antenna apparatus being configured to operate in a chosen mode of the plurality of different modes; and wherein the chosen deployment configuration is chosen in dependence on the chosen mode.

* * * * *